US011761147B2

(12) United States Patent
Kiyohara et al.

(10) Patent No.: US 11,761,147 B2
(45) Date of Patent: Sep. 19, 2023

(54) CREASING METHOD, CREASING APPARATUS, AND LONG FIBER NON-WOVEN FABRIC

(71) Applicant: ENEOS CORPORATION, Tokyo (JP)

(72) Inventors: Toshikazu Kiyohara, Tokyo (JP); Yuji Nishimura, Tokyo (JP)

(73) Assignee: ENEOS CORPORATION, Tokyo (JP)

( * ) Notice: Subject to any disclaimer, the term of this patent is extended or adjusted under 35 U.S.C. 154(b) by 298 days.

(21) Appl. No.: 17/254,493

(22) PCT Filed: Jul. 12, 2019

(86) PCT No.: PCT/JP2019/027703
§ 371 (c)(1),
(2) Date: Dec. 21, 2020

(87) PCT Pub. No.: WO2020/013316
PCT Pub. Date: Jan. 16, 2020

(65) Prior Publication Data

US 2021/0164155 A1 Jun. 3, 2021

(30) Foreign Application Priority Data

Jul. 13, 2018 (JP) ..... 2018-133397

(51) Int. Cl.
*D06J 1/08* (2006.01)
*D04H 3/00* (2012.01)
*D06J 1/10* (2006.01)

(52) U.S. Cl.
CPC ..... *D06J 1/08* (2013.01); *D04H 3/00* (2013.01); *D06J 1/10* (2013.01)

(58) Field of Classification Search
CPC ..... D04H 3/00; D06J 1/00; D06J 1/02; D06J 1/06; D06J 1/08; D06J 1/10
See application file for complete search history.

(56) References Cited

U.S. PATENT DOCUMENTS 2,821,237 A * 1/1958 Howard ..... D06J 1/10 223/32
3,505,155 A * 4/1970 Balch ..... D04H 3/00 28/283
3,785,904 A * 1/1974 Watson ..... D02J 1/18 19/163

(Continued)

FOREIGN PATENT DOCUMENTS

JP S51-29592 A 3/1976
JP S54-82198 U 6/1979

(Continued)

OTHER PUBLICATIONS

Oct. 15, 2019 International Search Report issued in International Patent Application No. PCT/JP2019/027703.

*Primary Examiner* — F Griffin Hall
(74) *Attorney, Agent, or Firm* — Oliff PLC

(57) ABSTRACT

A creasing method includes: a gripping and rotating step of bunching and gripping a continuously drawn long fiber non-woven fabric and rotating the gripped part so that the long fiber non-woven fabric is twisted and a first folding line is formed; a heating step of heating the twisted long fiber non-woven fabric to fix the first folding line; and a widening step of releasing the long fiber non-woven fabric having the first folding line formed thereon.

14 Claims, 6 Drawing Sheets

(56) References Cited

U.S. PATENT DOCUMENTS

| | | | | |
|---|---|---|---|---|
| 5,027,988 | A * | 7/1991 | Corbiere | D06J 1/00 112/63 |
| 2014/0248468 | A1* | 9/2014 | Kanayama | D04H 3/04 428/152 |
| 2019/0085492 | A1* | 3/2019 | Ibayashi | B32B 5/12 |

FOREIGN PATENT DOCUMENTS

| | | | |
|---|---|---|---|
| JP | S54-82199 | U | 6/1979 |
| JP | S55-111991 | U | 8/1980 |
| JP | H10-18175 | A | 1/1998 |
| JP | 2004-197287 | A | 7/2004 |
| JP | 2014-196585 | A | 10/2014 |
| JP | 2017-160549 | A | 9/2017 |
| KR | 10-0864559 | B1 | 10/2008 |
| WO | 2017/154871 | A1 | 9/2017 |

* cited by examiner

CREASING METHOD, CREASING APPARATUS, AND LONG FIBER NON-WOVEN FABRIC

TECHNICAL FIELD

The present invention relates to a creasing method and a creasing apparatus for forming a crease in a long fiber non-woven fabric and a long fiber non-woven fabric produced by them.

Priority is claimed on Japanese Patent Application No. 2018-133397, filed Jul. 13, 2018, the content of which is incorporated herein by reference.

BACKGROUND ART

As an example of a long fiber non-woven fabric having creases, Patent Document 1 below describes a long fiber non-woven fabric having irregular creases. The long fiber non-woven fabric is made of a polymer material and irregularly uneven creases are fixed on the polymer material of the long fiber non-woven fabric by heating an untreated raw fabric for a packed time in a bag and cooling the fabric in a room temperature across a glass transition point. The long fiber non-woven fabric having such creases is used for stuffing of futons and winter clothing.

As in Patent Document 1, in a method of packing an untreated long fiber non-woven fabric in a bag, it is difficult to continuously perform a creasing process and to continuously produce a long fiber non-woven fabric having creases.

Patent Document 2 below describes a long fiber non-woven fabric having creases. Two types of creases are formed on the long fiber non-woven fabric so that folding lines have different directions. That is, regular creases are formed so that the direction of the folding line of one crease intersects the direction of the folding line of the other crease. Patent Document 2 also describes a method of continuously forming two types of creases on the long fiber non-woven fabric. Specifically, an operator first compresses an untreated long fiber non-woven fabric in the width direction of the raw fabric so that a crease in which a folding line follows the longitudinal direction of the raw fabric is formed on the long fiber non-woven fabric. Next, the long fiber non-woven fabric is put into a crease forming mechanism and a crease forming roller is pressed against the long fiber non-woven fabric in a heated state while the long fiber non-woven fabric is supplied in the longitudinal direction of the raw fabric. At this time, a crease in which a folding line follows the width direction of the raw fabric is formed on the long fiber non-woven fabric by setting a speed difference between a raw fabric supply speed and a rotation speed of an outer peripheral surface of the crease forming roller. Accordingly, the two types of creases are continuously fixed on the long fiber non-woven fabric.

CITATION LIST

Patent Documents

Patent Document 1: Japanese Unexamined Patent Application, First Publication No. 2014-196585

Patent Document 2: Japanese Unexamined Patent Application, First Publication No. 2017-160549

SUMMARY OF INVENTION

Technical Problem

As in Patent Document 1, when irregular uneven creases are formed on the long fiber non-woven fabric, the degree of unevenness varies depending on the location and the effect (for example, heat retention) required for the creased long-fiber non-woven fabric may not be sufficiently obtained.

As in Patent Document 2, when two types of creases having folding lines formed in different directions are formed, the continuous production is possible, but the regular folding lines cannot sufficiently maintain bending habit. As a result, also in this method, there is a possibility that the effects required for the long fiber non-woven fabric using the crease cannot be obtained.

The present invention has been made in view of the above-described circumstances and an object of the present invention is to provide a creasing method and a creasing apparatus capable of maintaining bending habit of a crease for a long time and forming a crease in a long fiber non-woven fabric to sufficiently exhibit effects such as heat retention and a long fiber non-woven fabric produced thereby.

Solution to Problem

A creasing method according to a first aspect of the present invention includes: a gripping and rotating step of bunching and gripping a certain part of a continuously supplied long fiber non-woven fabric in a longitudinal direction and rotating the gripped part of the long fiber non-woven fabric within a plane intersecting a drawing direction of the long fiber non-woven fabric so that the long fiber non-woven fabric is twisted and a folding line in the longitudinal direction is formed on the long fiber non-woven fabric; a first heating step of heating the twisted long fiber non-woven fabric to fix the folding line to the long fiber non-woven fabric after the first gripping and rotating step; and a first widening step of releasing the long fiber non-woven fabric having the folding line fixed thereto to widen the long fiber non-woven fabric in a width direction after the first heating step.

A creasing apparatus according to a second aspect of the present invention includes: a first gripping and rotating part which is configured to bunch and grip a certain part of a continuously supplied long fiber non-woven fabric and configured to rotate the gripped part of the long fiber non-woven fabric within a plane intersecting a drawing direction of the long fiber non-woven fabric so that the long fiber non-woven fabric is twisted and a first folding line in the longitudinal direction is formed on the long fiber non-woven fabric; a first heating part which is disposed on a downstream side of the first gripping and rotating part in the drawing direction and configured to heat the long fiber non-woven fabric twisted by the first gripping and rotating part so that the first folding line is fixed to the long fiber non-woven fabric; and a first widening part which is disposed on a downstream side of the first heating part in the drawing direction and configured to release the long fiber non-woven fabric having the first folding line fixed thereto by the first heating part so that the long fiber non-woven fabric is widened in a width direction.

A long fiber non-woven fabric according to a third aspect of the present invention includes: a plurality of first long fiber filaments which are arranged in parallel in a longitudinal direction; and a plurality of second long fiber filaments which are arranged in parallel in a width direction of the first long fiber filament and are laminated and bonded to the first long fiber filaments, wherein a plurality of first vertical creases are formed substantially regularly to extend in a direction inclined with respect to the longitudinal direction and a plurality of second vertical creases are formed substantially regularly to extend in a direction inclined with respect to the longitudinal direction at an inclined angle different from that of the first vertical crease.

Advantageous Effects of Invention

According to the present invention, a continuously supplied long fiber non-woven fabric is twisted and further the twisted long fiber non-woven fabric is heated to fix a folding line. When the long fiber non-woven fabric is viewed from a cross-section along a width direction, a crease is formed to draw a continuous wave in the long fiber non-woven fabric. When the wavy crease is formed in the long fiber non-woven fabric in this way, rigidity in the width direction is generated in the long fiber non-woven fabric and a restoring force when the creases are stretched in the width direction of the long fiber non-woven fabric can be obtained. As a result, the bending habit of the crease can be maintained for a long time and the effects required for the long fiber non-woven fabric last for a long time.

DESCRIPTION OF EMBODIMENTS

First Embodiment

A first embodiment of a creasing apparatus according to the present invention will be described with reference to FIG. 1 to FIG. 5.

First, a long fiber non-woven fabric to be creased in the embodiment will be described. A structure thereof is formed such that long fibers made of thermoplastic resin are arranged vertically and horizontally, these long fibers are bonded to each other, and long fibers arranged vertically on one side is secured to be much longer than the long fibers arranged horizontally on the other side, so that the long fiber non-woven fabric is formed in a long strip shape in advance. This long fiber non-woven fabric is produced by a method such as a spunbonding method, a melt-blown method, or an orthogonal laminated bonding method, but is preferably produced by an orthogonal laminated bonding method. Since the long fiber non-woven fabric which is produced by the orthogonal laminated bonding method (hereinafter, referred to as the "orthogonal laminated non-woven fabric") can obtain sufficient tensile strength even when the thickness is reduced and can reduce the weight per unit area, the long fiber non-woven fabric is good in dimensional stability (dimensions are hard to change even when tension is applied). For example, it is preferable that the specifications of the orthogonal laminated non-woven fabric to be creased be within the following ranges.

Basis weight: 5 to 100 g/m$^2$

Thickness: 50 to 130 μm

Vertical (longitudinal) tensile strength: 20 to 300 [N/50 mm] Horizontal tensile strength: 5 to 150 [N/50 mm]

Since the orthogonal laminated non-woven fabric is generally characterized in that the shape retention during bending becomes smaller as the basis weight value becomes smaller and the bulkiness is impaired as the basis weight value becomes larger, the basis weight value of the orthogonal laminated non-woven fabric used in the embodiment is preferably in the range of 5 to 60 g/m$^2$ and more preferably in the range of 8 to 40 g/m$^2$.

Further, the thickness of the long fiber non-woven fabric used in the embodiment is preferably in the range of 60 to 100 μm.

Figure 1:
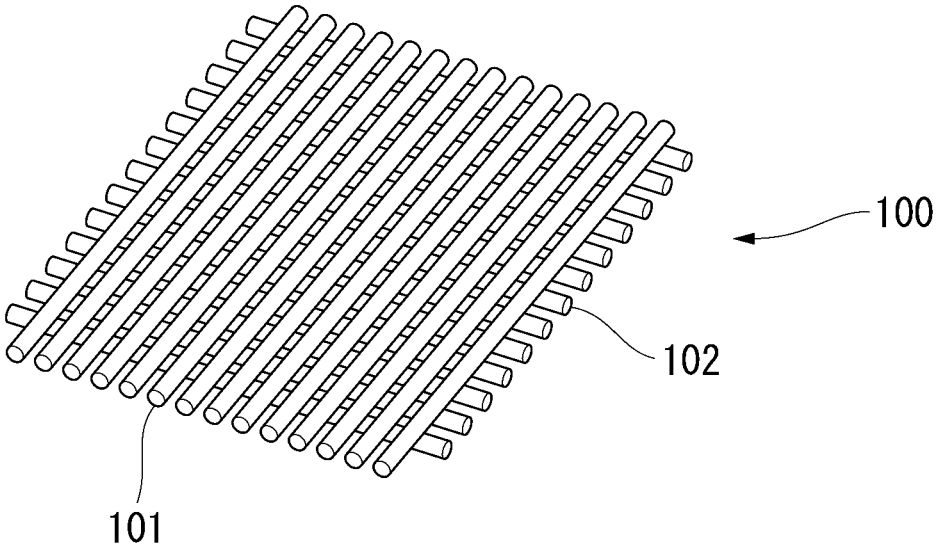
FIG. 1 is a perspective view showing a structure of a long fiber non-woven fabric to be processed by a creasing apparatus according to the present invention.

FIG. 1 shows an example of a structure of an orthogonal laminated non-woven fabric before creasing. An orthogonal laminated non-woven fabric 100 shown in the drawing is substantially produced according to the following procedure. First, a vertically arranged long fiber non-woven fabric (vertical web) 101 is produced by arranging a plurality of long fiber filaments spun from thermoplastic resin in parallel along the longitudinal direction (the vertical direction) and further stretching the filaments in the longitudinal direction. Further, a horizontally arranged long fiber non-woven fabric (horizontal web) 102 is produced by arranging another long fiber filaments spun from thermoplastic resin in parallel along the width direction (horizontal direction) and further stretching the filaments in the width direction. Next, the orthogonal laminated non-woven fabric 100 is obtained in such a manner that the vertical web 101 and the horizontal web 102 are laminated and bonded so that the filaments are orthogonal to each other.

The thermoplastic resin used as the material for the filament is required to be a crystalline resin that can be processed into a thread shape. For example, polyester (polyethylene terephthalate, etc.), polyamide (nylon, etc.), and polyolefin (polypropylene, polyethylene, etc.) are used. Among these exemplified materials, polyester (particularly, polyethylene terephthalate) is preferably used since polyester has characteristics in that creases are easily formed and bending habits are difficult to be removed. In the case of polyester, flame-retardant polyester which has been made flame-retardant by copolymerizing, for example, a phosphorus-based flame-retardant component is preferably used since polyester has a high flame-retardant property.

Incidentally, as the filament forming the orthogonal laminated non-woven fabric used in the embodiment, one having a wire diameter of 0.1 to 100 μm can be used. However, in order to sufficiently exhibit the above-described characteristics, a wire diameter in the range of 0.3 to 20 μm is preferable and a wire diameter in the range of 1 to 15 μm is more preferable.

Figure 2:
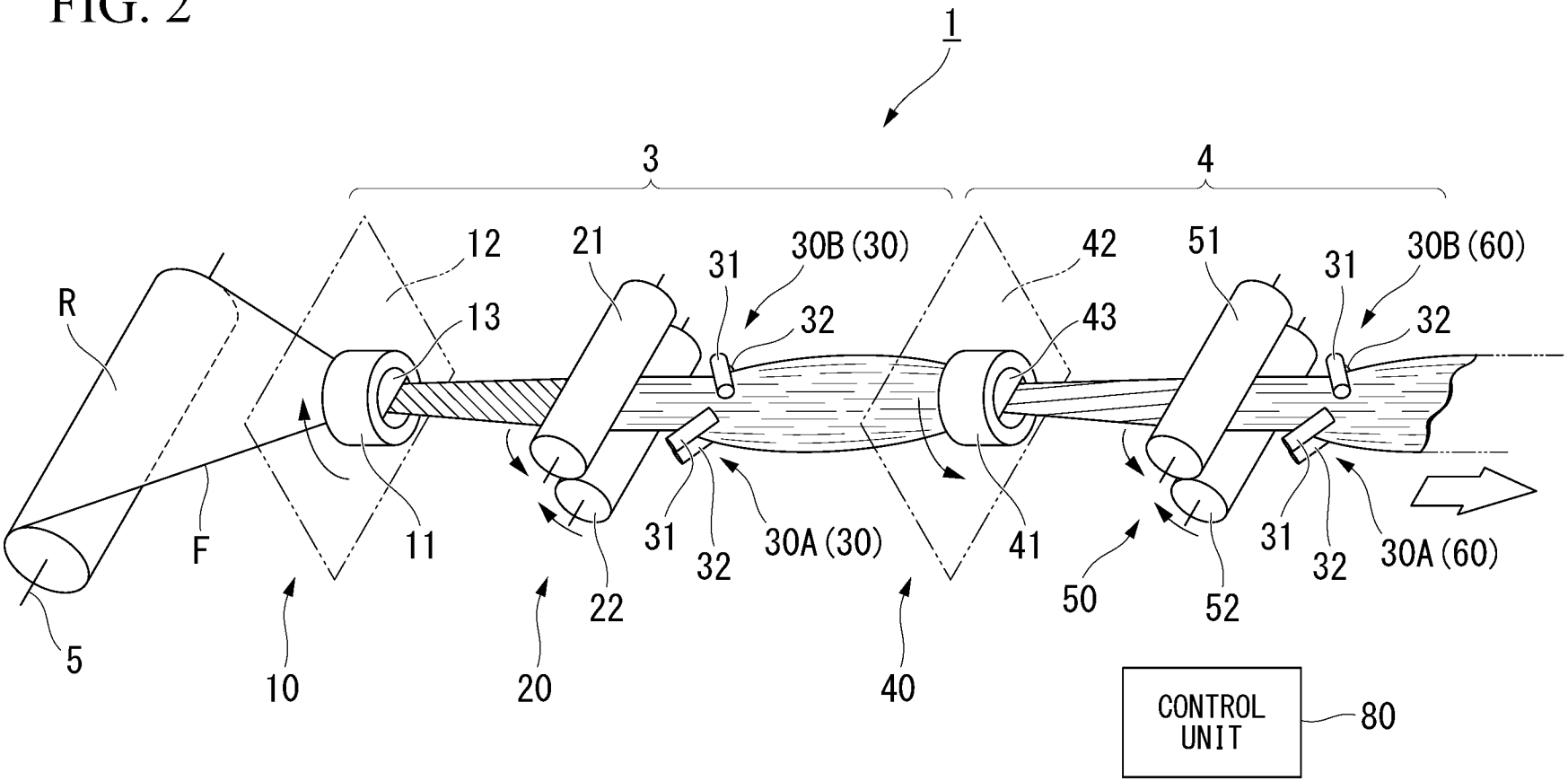
FIG. 2 is a perspective view schematically showing a structure of a vertical creasing apparatus included in a first embodiment of the creasing apparatus according to the present invention.
Figure 3:
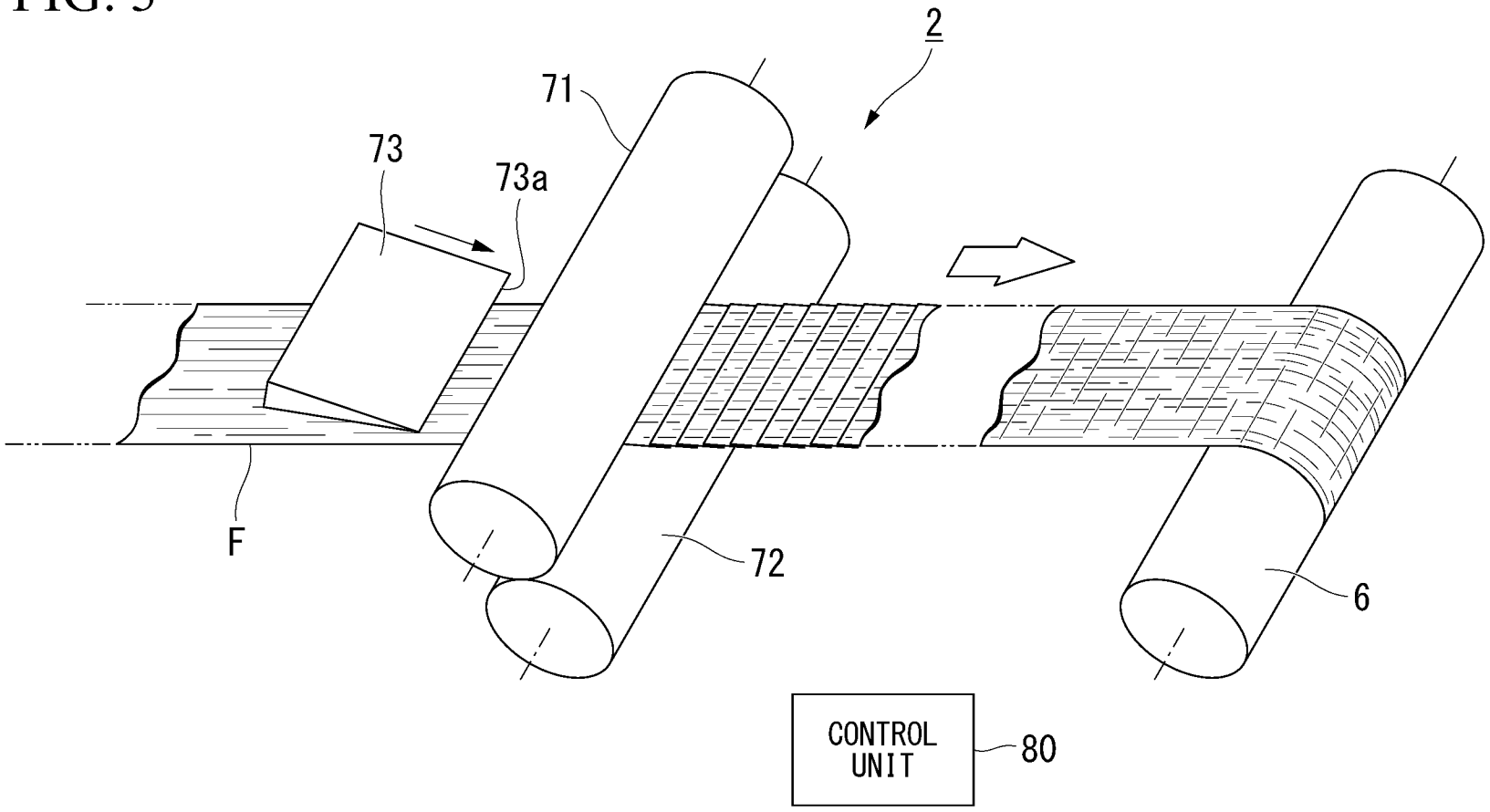
FIG. 3 is a perspective view schematically showing a structure of a horizontal creasing apparatus included in the first embodiment of the creasing apparatus according to the present invention.
Figure 4:
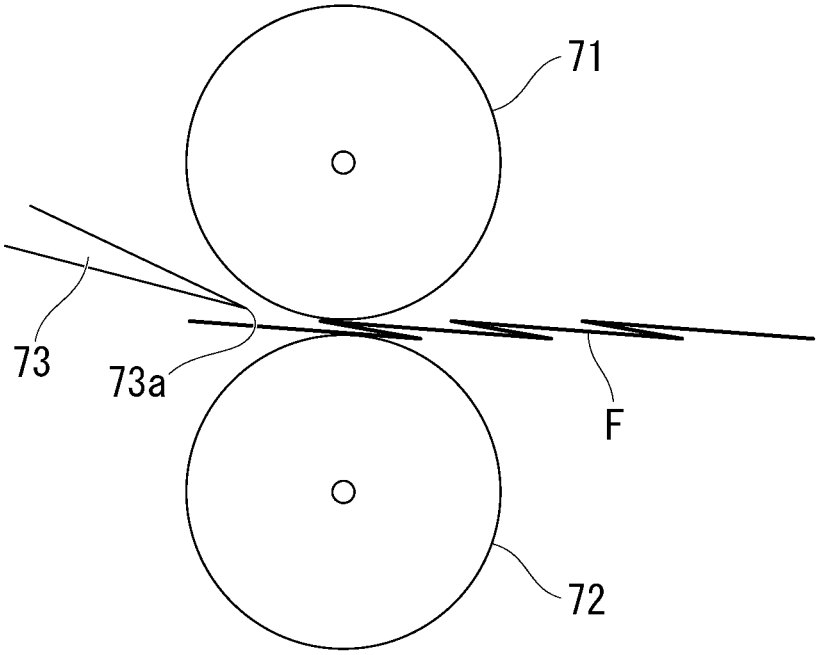
FIG. 4 is a cross-sectional view simply showing a state of a long fiber non-woven fabric sent to the horizontal creasing apparatus.

FIG. 2 and FIG. 3 show an example of a structure of the creasing apparatus. The creasing apparatus shown in the drawings includes a vertical creasing apparatus 1 which forms a vertical crease of a folding line in the longitudinal direction in a continuously supplied long fiber non-woven fabric F (see FIG. 2), a horizontal creasing apparatus 2 which forms a horizontal crease of a folding line in the width direction in the long fiber non-woven fabric F having the vertical crease formed therein (see FIG. 3), and a control unit 80 which controls the operations of the vertical creasing apparatus 1 and the horizontal creasing apparatus 2.

As shown in FIG. 2, the vertical creasing apparatus 1 of the embodiment is divided into a first processing part 3 which is located on the upstream side and a second processing part 4 which is located on the downstream side in a direction in which the long fiber non-woven fabric F is drawn. The first processing part 3 includes a gripping and rotating part (a first gripping and rotating part) 10, a heating part (a first heating part) 20, and a widening part (a first widening part) 30 and the second processing part 4 includes a gripping and rotating part (a second gripping and rotating part) 40, a heating part (a second heating part) 50, and a widening part (a second widening part) 60. A center core 5 which is supported to be rotatable is disposed on the upstream side of the vertical creasing apparatus 1 and the long fiber non-woven fabric F is drawn out from an unprocessed roll R of which the long fiber non-woven fabric F is wound on the center core 5 to the first processing part 3 and is drawn out from the first processing part 3 to the second processing part 4.

The gripping and rotating part 10 includes an annular gripping member 11 which is supported to be rotatable within a plane intersecting the drawing direction of the long fiber non-woven fabric F and a rotation mechanism 12 which rotates the gripping member. The gripping member 11 includes a pinch mechanism 13 which sandwiches and grips the long fiber non-woven fabric F passing through the center hole. The number of rotations and the forward and reverse rotation directions of the gripping member 11 are controlled by the control unit 80 and the number of times of twisting the long fiber non-woven fabric F in one operation can be arbitrarily set according to the form of the vertical crease to be applied to the long fiber non-woven fabric F to be processed.

The heating part 20 is disposed on the downstream side of the gripping and rotating part 10 in the drawing direction of the long fiber non-woven fabric F and includes two rollers 21 and 22 which sandwich the long fiber non-woven fabric F twisted by the gripping and rotating part 10 from above and below. A heating element (not shown) is embedded in at least one of the rollers 21 and 22 and heats the long fiber non-woven fabric F sent between two rollers 21 and 22 in a direct contact state. The heating temperature of the heating part 20 can be arbitrarily set in response to the material of the long fiber non-woven fabric F to be processed.

The widening part 30 is disposed on the downstream side of the heating part 20 in the drawing direction of the long fiber non-woven fabric F and releases (unravels) and widens the long fiber non-woven fabric F twisted by the gripping and rotating part 10 and having the vertical crease. Any widening device can be selected, but known widening devices such as a cross guider, an expander roll, and a tentering machine can be adopted. In the embodiment, cross guiders 30A and 30B including a set of two pinch rollers 31 and 32 are arranged one by one on both sides of the transport path of the long fiber non-woven fabric F and both side edges of the long fiber non-woven fabric F sent out from the heating part 20 are pinched. The cross guider 30A (30B) is disposed by inclining the rotation axes of the pinch rollers 31 and 32 depending on the method of drawing the long fiber non-woven fabric F. Specifically, the pinch rollers 31 and 32 are inclined so that one ends of the pinch rollers 31 and 32 on the inside are located on the upstream side in the drawing direction of the long fiber non-woven fabric F in relation to the other ends of the pinch rollers on the outside. Accordingly, the long fiber non-woven fabric F gripped by the pinch rollers 31 and 32 is widened in the width direction as it goes toward the downstream side.

The gripping and rotating part 40 is disposed on the downstream side of the widening part 30 in the drawing direction of the long fiber non-woven fabric F. The gripping and rotating part 40 basically has the same structure as that of the gripping and rotating part 10 and includes an annular gripping member 41 and a rotation mechanism 42 which rotates the gripping member 41. The gripping member 41 includes a pinch mechanism 43 which sandwiches and grips the long fiber non-woven fabric F. The number of rotations and the forward and reverse rotation directions of the gripping member 41 are controlled by the control unit 80 and the number of times of twisting the long fiber non-woven fabric F in one operation can be arbitrarily set according to the form of the vertical crease to be applied to the long fiber non-woven fabric F to be processed.

The heating part 50 is disposed on the downstream side of the gripping and rotating part 40 in the drawing direction of the long fiber non-woven fabric F. The heating part 50 basically has the same structure as that of the heating part 20 and includes two rollers 51 and 52 which sandwich the twisted long fiber non-woven fabric F from above and below. A structure in which a heating element (not shown) is embedded in at least one of the rollers 51 and 52 is also common and the heating element heats the long fiber non-woven fabric F in a direct contact state. The heating temperature of the heating part 50 can be arbitrarily set in response to the material of the long fiber non-woven fabric F to be processed.

The widening part 60 is disposed on the downstream side of the heating part 50 in the drawing direction of the long fiber non-woven fabric F and releases (unravels) and widens the long fiber non-woven fabric F twisted by the gripping and rotating part 40 and having the vertical crease. Any widening device can be selected, but known widening device or the cross guiders 30A and 30B can be adopted similarly to the widening part 30.

As shown in FIG. 3, the horizontal creasing apparatus 2 includes two drums (first and second conveying bodies) 71 and 72 and a blade 73.

The drums 71 and 72 are disposed on the downstream side of the widening part 60. The drum 71 is in contact with the upper surface of the long fiber non-woven fabric F having the folding line formed by the vertical creasing apparatus 1 and is supported to be rotatable about a predetermined axis intersecting the width direction of the long fiber non-woven fabric F. The drum 72 is parallel to the drum 71, is in contact with the lower surface of the long fiber non-woven fabric F and is supported to be rotatable about the predetermined in the width direction of the long fiber non-woven fabric F similarly to the drum 71.

The blade 73 is disposed on the upstream side of the drums 71 and 72 in the drawing direction of the long fiber non-woven fabric F so that a linear edge 73*a* formed at the front end faces the drums 71 and 72. The blade 73 is operated by an actuator (not shown) and the edge 73*a* of the blade is pressed against the long fiber non-woven fabric F to be supplied to the drums 71 and 72 so that the long fiber non-woven fabric is pressed between both drums from the upstream side of the drums 71 and 72. A heating element is embedded in at least one of the drums 71 and 72 and heats the long fiber non-woven fabric F sent between two drums 71 and 72 in a direct contact state (a third heating part). The heating temperature of the drum 71 (or 72) can be arbitrarily set in response to the material of the long fiber non-woven fabric F to be processed.

A center core 6 on which the long fiber non-woven fabric F is wound is disposed on the downstream side of the horizontal creasing apparatus 2. The center core 6 is provided with a drive mechanism (not shown) and the treated long fiber non-woven fabric F having been creased is wound on the center core 6.

Hereinafter, a process of creasing the long fiber non-woven fabric F made of polyester (polyethylene terephthalate) which is thermoplastic resin using the creasing apparatus of the embodiment with the above-described configuration will be described.

First, as an initial preparation step, the leading end of the long fiber non-woven fabric F is drawn out from the roll R so that the leading end sequentially passes through the gripping member 11 of the gripping and rotating part 10, a gap between the rollers 21 and 22 of the heating part 20, the widening part 30, the gripping member 41 of the gripping and rotating part 40, a gap between the rollers 51 and 52 of the heating part 50, and the widening part 60. Further, the leading end of the long fiber non-woven fabric F passes through a gap between the drums 71 and 72 to be fixed to the center core 6. In the initial step, the pinch mechanism of the gripping member 11 and the pinch mechanism of the gripping member 41 grip the long fiber non-woven fabric F and the rollers 21 and 22 of the heating part 20 and the rollers 51 and 52 of the heating part 50 maintain the pressure contact state with respect to the long fiber non-woven fabric F from the beginning. Further, the heating temperature of the heating parts 20 and 50 is preferably set in consideration of the crystallization temperature of polyethylene terephthalate which is a material of the long fiber non-woven fabric F so that each heating temperature is higher than the crystallization temperature of polyethylene terephthalate and is lower than the melting point of polyethylene terephthalate. Specifically, an appropriate temperature included in the range of 120° C. to 200° C. is selected and set.

(Gripping and Rotating Step: First Time)

Next, when the actual creasing step starts, in the first processing part 3, the gripping member 11 of the gripping and rotating part 10 is operated so that a certain part of the long fiber non-woven fabric F in the longitudinal direction is bunched and gripped and the gripped part is rotated by a predetermined number of rotations (a first number of rotations, that is, the number of times of twisting the long fiber non-woven fabric F in one operation instead of the number of rotations per unit time) while the long fiber non-woven fabric F is continuously received from the roll R. Accordingly, since the long fiber non-woven fabric F is twisted, a folding line (a first folding line) is formed on the long fiber non-woven fabric F in the longitudinal direction. The gripping member 11 is stopped when rotating by a predetermined number of rotations and rotates in the reverse direction after a predetermined time while gripping the long fiber non-woven fabric F. While the gripping member 11 is stopped, the long fiber non-woven fabric F is sent to the heating part 20 through the gripping member 11. Here, the time for stopping the gripping member 11 is appropriately determined in consideration of the volume of the first vertical crease (that is, the crease due to the first folding line) to be formed on the long fiber non-woven fabric F, the number of creases per unit length, and the like. Additionally, the rotation of the gripping member 11 may not be essentially stopped while the long fiber non-woven fabric F is sent.

Then, the twisting operation is repeated while switching the rotation direction of the gripping member 11.

(First Heating Step: First Time)

The long fiber non-woven fabric F twisted by the gripping member 11 is sent to the heating part 20 and is sandwiched between the rollers 21 and 22 that generate heat while maintaining the state. Accordingly, the long fiber non-woven fabric F is heated in a twisted state and the temperature of the long fiber non-woven fabric F made of thermoplastic resin rises to exceed the crystallization temperature of polyethylene terephthalate.

The long fiber non-woven fabric F loses a temperature depending on the ambient environment temperature while being sent from the rollers 21 and 22 to the widening part 30 so that the temperature falls to the glass transition point or less of polyethylene terephthalate. Accordingly, the folding line (the first folding lines) in the longitudinal direction is fixed to the long fiber non-woven fabric F.

(First Widening Step: First Time)

The long fiber non-woven fabric F having the folding line fixed thereto is widened by the cross guiders 30A and 30B in the widening part 30 so that the crease is released (however, the first folding line is maintained in a fixed state).

The gripping and rotating step, the first heating step, and the first widening step performed so far are referred to as a first cycle and in the embodiment, the same cycle is performed once more in succession.

(Gripping and Rotating Step: Second Time)

In the second processing part 4, the gripping member 41 is operated so that a certain part of the long fiber non-woven fabric F in the longitudinal direction in the long fiber non-woven fabric F supplied from the widening part 30 to the gripping and rotating part 40 is bunched and gripped and the gripped part is rotated by a predetermined number of rotations (a second number of rotations, that is, the number of times of twisting the long fiber non-woven fabric F in one operation instead of the number of rotations per unit time) smaller than the number of rotations of the gripping and rotating part 40. Accordingly, since the long fiber non-woven fabric F is twisted, another folding line (a second folding line) is formed on the long fiber non-woven fabric F in the longitudinal direction. The gripping member 11 is stopped when rotating by a predetermined number of rotations and rotates in the reverse direction after a predetermined time while gripping the long fiber non-woven fabric F. While the gripping member 41 is stopped, the long fiber non-woven fabric F is sent to the heating part 50 through the gripping member 41. Here, the time for stopping the gripping member 41 is appropriately determined in consideration of the volume of the second vertical crease (that is, the crease due to the second folding line) to be formed on the long fiber non-woven fabric F, the number of creases per unit length, and the like. Additionally, the rotation of the gripping member 41 may not be essentially stopped while the long fiber non-woven fabric F is sent. Then, the twisting operation is repeated while switching the rotation direction of the gripping member 41.

(First Heating Step: Second Time)

The long fiber non-woven fabric F twisted by the gripping member 41 is sent to the heating part 50 and is sandwiched between the rollers 51 and 52 that generate heat while maintaining the state. Accordingly, the long fiber non-woven fabric F is heated in a twisted state and the temperature thereof rises to exceed the crystallization temperature of polyethylene terephthalate.

The long fiber non-woven fabric F loses a temperature depending on the ambient environment temperature while being sent from the rollers 51 and 52 to the widening part 60 so that the temperature falls to the glass transition point or less of polyethylene terephthalate. Accordingly, another folding line (the second folding line) in the longitudinal direction is fixed to the long fiber non-woven fabric F.

(First Widening Step: Second Time)

The long fiber non-woven fabric F having the first and second folding lines fixed thereto is widened by the cross guiders 30A and 30B in the widening part 60 so that the crease is released. However, the first and second folding lines are fixed to the long fiber non-woven fabric F as the first and second vertical creases (W1 and W2).

(Press-Inserting Step)

Next, in the horizontal creasing apparatus 2, the blade 73 is operated at equal time intervals while the long fiber non-woven fabric F sent from the widening part 60 to a gap between the drums 71 and 72 is continuously supplied in the longitudinal direction and the long fiber non-woven fabric F to be supplied to the drums 71 and 72 is pressed from the upstream side of the drums 71 and 72 into a gap between both drums. Accordingly, the press-inserted long fiber non-woven fabric F overlaps with the long fiber non-woven fabric F already sandwiched between the drums 71 and 72 and folded folds are formed on the long fiber non-woven fabric F sandwiched between the drums 71 and 72 (see FIG. 4). Accordingly, a folding line (a third folding line) in the width direction is formed on the long fiber non-woven fabric F. The blade 73 continuously forms folds by performing the next press-inserting operation when the long fiber non-woven fabric F is sent out by a predetermined length.

(Second Heating Step)

The long fiber non-woven fabric F is heated by the drums 71 and 72 that generate heat while maintaining the folds so that the temperature rises to exceed the crystallization temperature of polyethylene terephthalate.

The long fiber non-woven fabric F loses a temperature depending on the ambient environment temperature while being sent from the drums 71 and 72 so that the temperature falls to the glass transition point or less of polyethylene terephthalate. Accordingly, the folding line (the third folding line) in the width direction is fixed to the long fiber non-woven fabric F. The long fiber non-woven fabric F having the folding line fixed thereto in the width direction is drawn out from the horizontal creasing apparatus 2 in the longitudinal direction so that the crease is released. However, the folding line in the width direction is fixed to the long fiber non-woven fabric F as the horizontal crease.

(Second Widening Step)

The long fiber non-woven fabric F having the third folding line fixed thereto is widened while being wound on the center core 6 so that the fold is opened. However, the third folding line is fixed to the long fiber non-woven fabric F as the horizontal crease.

The press-inserting step, the second heating step and the second widening step performed so far are referred to as a second cycle.

In the embodiment, the long fiber non-woven fabric F is creased through the above-described processes.

Figure 5:
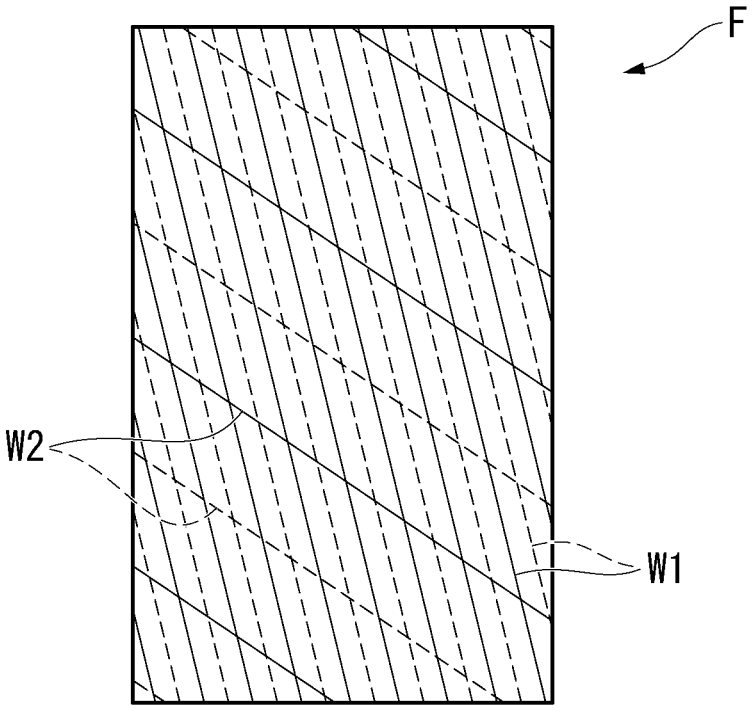
FIG. 5 is a plan view simply showing a state of creases of a long fiber non-woven fabric provided with vertical creases.

In the embodiment, the continuously supplied long fiber non-woven fabric F is twisted twice by making the number of times of twisting in the first gripping and rotating step different from the number of times of twisting in the second gripping and rotating step. The number of the first folding lines formed on the long fiber non-woven fabric F when the number of times of twisting in the first gripping and rotating step is large is larger than the number of the second folding lines formed on the long fiber non-woven fabric F when the number of times of twisting in the second gripping and rotating step is smaller than that in the first gripping and rotating step. Looking at the long fiber non-woven fabric F in the cross-section in the width direction through the first and second heating steps, as shown in FIG. 5, two types of vertical creases having different periods are fixed to the long fiber non-woven fabric F so as to draw continuous waves when viewed in the cross-section. That is, large wavy creases are formed on the long fiber non-woven fabric F having small wavy creases. In FIG. 5, W1 indicates the first vertical crease having a small period formed by the first gripping and rotating step and the first heating step and W2 indicates the second vertical crease having a large period formed by the second gripping and rotating step and the second heating step. Further, in the vertical creases W1 and W2, the dashed line indicates the crease that becomes a valley and the solid line indicates the crease that becomes a mountain when the long fiber non-woven fabric F is viewed in a plan view.

Since the number of rotations (number of twists) in one operation is different between the first gripping and rotating step and the second gripping and rotating step, the traveling direction of the wave of the first vertical crease W1 having a small period intersects the traveling direction of the wave of the second vertical crease W2 having a large period. Further, since the number of rotations of the first gripping and rotating step is different from the number of rotations of the second gripping and rotating step, an angle formed by the traveling direction of the wave of the crease W1 with respect to the longitudinal direction of the long fiber non-woven fabric F becomes smaller than an angle formed by the traveling direction of the wave of the crease W2 with respect to the longitudinal direction of the long fiber non-woven fabric F. When two types of creases having different periods are formed in this way, rigidity in the width direction is generated in the long fiber non-woven fabric F and a restoring force when the creases are stretched in the width direction of the long fiber non-woven fabric F can be obtained.

Further, when the third folding line is formed in the width direction of the long fiber non-woven fabric F to intersect the first and second folding lines, the horizontal crease is fixed to the long fiber non-woven fabric F. The horizontal crease can increase the volume of the long fiber non-woven fabric F and obtain a restoring force when the long fiber non-woven fabric is stretched in the vertical direction.

That is, since a restoring force applied in two directions of the width direction and the vertical direction is given to the long fiber non-woven fabric F, the bending habit of the crease can be maintained for a long time. As a result, the effects required for the long fiber non-woven fabric, for example, the effects such as heat retention last for a long time.

In the embodiment, although the number of rotations of the long fiber non-woven fabric F in the first gripping and rotating step is larger than the number of rotations in the second gripping and rotating step, the number of rotations of the long fiber non-woven fabric F in the first gripping and rotating step may become smaller than the number of rotations in the second gripping and rotating step or the number of rotations of the long fiber non-woven fabric F in the first gripping and rotating step may be the same as the number of rotations in the second gripping and rotating step.

Further, in the embodiment, although the rotation directions in the first and second gripping and rotating steps are not particularly specified, it is preferable that the gripping members 11 and 41 do not always rotate in one direction but rotate alternately in the forward and reverse directions by considering that the long fiber non-woven fabric F is a long piece of cloth.

In the embodiment, the long fiber non-woven fabric F made of polyethylene terephthalate has been adopted to be creased, but the material to be processed is required to be a crystalline resin that can be processed into a thread shape like polyethylene terephthalate. Further, for the purpose of creasing the non-woven fabric by fixing the folding line thereto, it is preferable to select a material having an appropriate glass transition point and crystallization temperature that enables such processing. In this regard, it is preferable to set the heating temperature of the heating parts 20 and 50 in consideration of the material selected in the embodiment, that is, the crystallization temperature of polyethylene terephthalate so that each heating temperature is higher than the crystallization temperature of polyethylene terephthalate and lower than the melting point of polyethylene terephthalate. Specifically, an appropriate temperature included in the range of 120° C. to 200° C. is selected and set.

In the embodiment, although the gripping and rotating step, the first heating step, and the first widening step are referred to as one cycle (the first cycle) and the same cycle is performed twice in succession, the same cycle may be repeated three times or more. Further, although the press-inserting step, the second heating step, and the second widening step are referred to as another cycle (the second cycle) and the second cycle is performed once after repeating the first cycle, the second cycle may be performed whenever finishing the first cycle and the second cycle may be performed the same number of times as the first cycle.

In the embodiment, although the rotation directions in the first gripping and rotating step and the second gripping and rotating step are set to be different from each other and the operation of twisting the long fiber non-woven fabric F is repeated while switching the forward and reverse rotation directions of the gripping members 11 and 41, the rotation directions in the first gripping and rotating step and the second gripping and rotating direction may be the same as each other and the operation of twisting the long fiber non-woven fabric F may be repeated.

Figure 6:
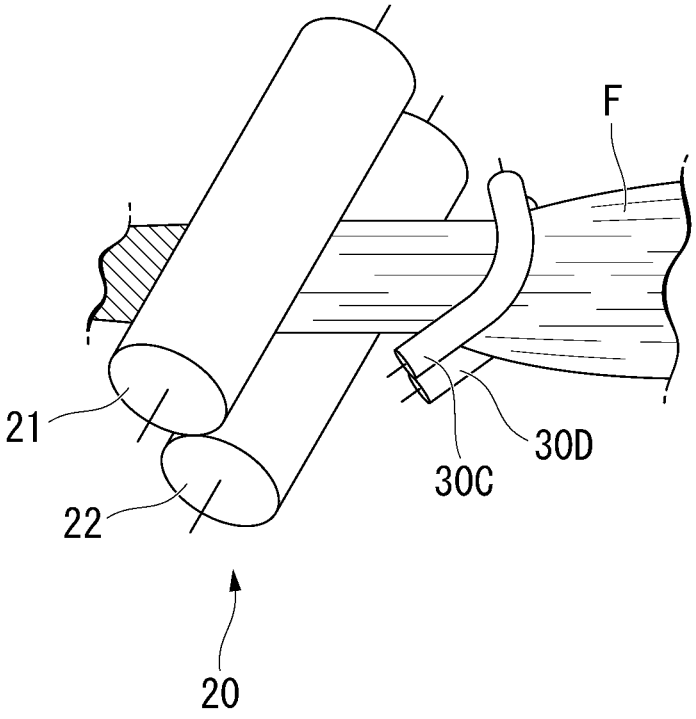
FIG. 6 is a perspective view showing an expander roll which can be used for a widening part.

In the embodiment, the widening parts 30 and 60 have adopted the cross guiders 30A and 30B as known widening device, but may adopt an expander roll shown in FIG. 6 instead of them. The expander roll has a configuration in which two rolls 30C and 30D arranged in the width direction of the long fiber non-woven fabric F are curved so that the center of each roll is located on the downstream side in the drawing direction of the long fiber non-woven fabric F in relation to both ends and these two rolls 30C and 30D are rotated while being pressed against both surfaces of the long fiber non-woven fabric F. The long fiber non-woven fabric F which is in contact with the center of the rolls 30C and 30D travels in the drawing direction, but a portion contacting the end portions of the rolls 30C and 30D obliquely travels to be away from the center of the roll as it goes toward the downstream side. Accordingly, the long fiber non-woven fabric F is widened in the width direction as it goes toward the downstream side.

Second Embodiment

A second embodiment of the creasing apparatus according to the present invention will be described with reference to FIG. 7.

Figure 7:
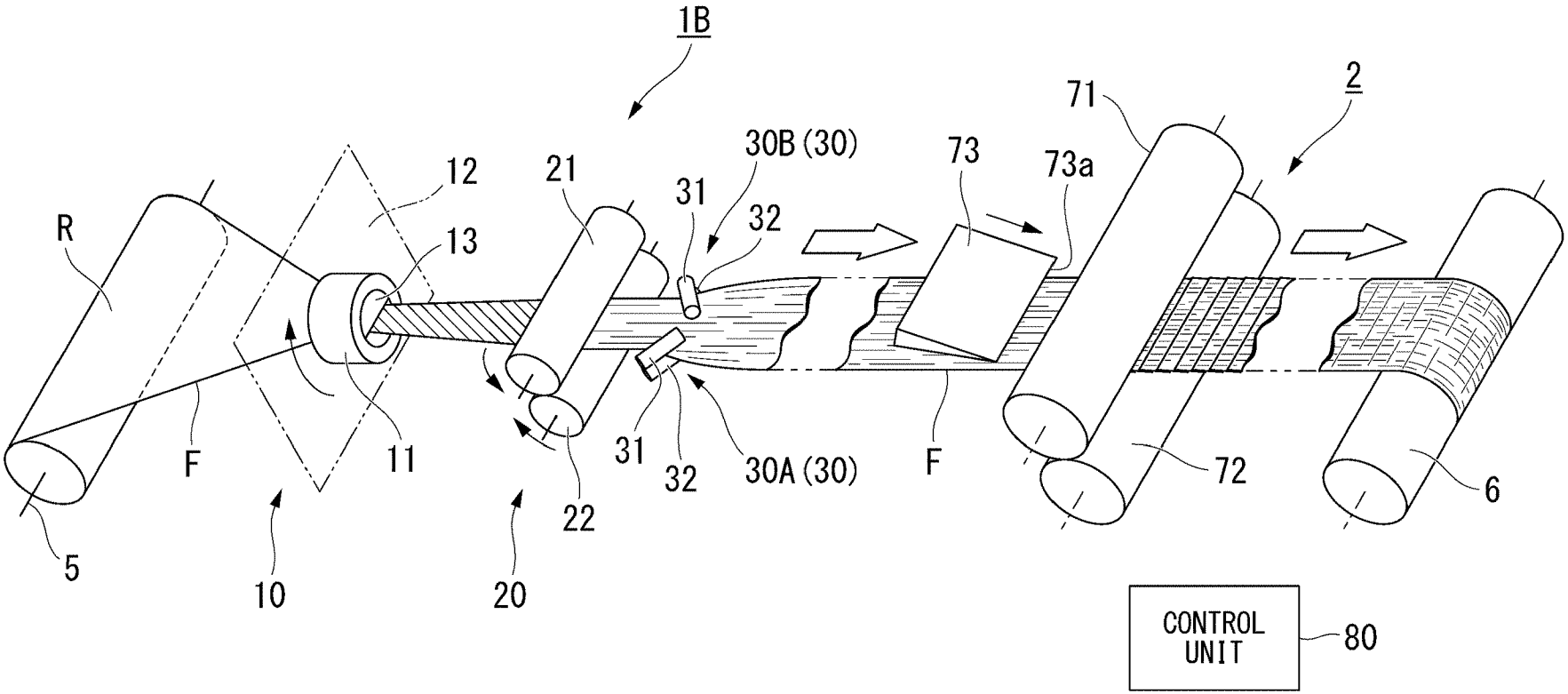
FIG. 7 is a perspective view schematically showing a second embodiment of the creasing apparatus according to the present invention.

As shown in FIG. 7, a vertical creasing apparatus 1B of the embodiment includes a gripping and rotating part (a first gripping and rotating part) 10, a heating part (a first heating part) 20, and a widening part (a first widening part) 30. A center core 5 which is supported to be rotatable is disposed on the upstream side of a vertical creasing apparatus 1 and a long fiber non-woven fabric F is drawn out from an unprocessed roll R of which the long fiber non-woven fabric F is wound on the center core 5 toward a first processing part 3. Since the structures of the gripping and rotating part 10, the heating part 20, and the widening part 30 are the same as those of the first embodiment, description thereof will be omitted. Further, although a horizontal creasing apparatus 2 is also included in the creasing apparatus of the embodiment, the description thereof will be omitted since the structure is also the same as the first embodiment.

Hereinafter, a process of creasing the long fiber non-woven fabric F made of polyester (polyethylene terephthalate) which is thermoplastic resin using the creasing apparatus of the embodiment including the vertical creasing apparatus 1B will be described. Additionally, since the initial preparation step is the same as that of the first embodiment, detailed description will be omitted.

(Gripping and Rotating Step)

First, in the gripping and rotating part 10, a certain part of the long fiber non-woven fabric F is gripped by the gripping member 11 and the gripped part is rotated by a predetermined number of rotations (a first number of rotations, that is, the number of times of twisting the long fiber non-woven fabric F in one operation instead of the number of rotations per unit time) while the long fiber non-woven fabric F is continuously received from the roll R. Accordingly, since the long fiber non-woven fabric F is twisted, a folding line (a first folding line) in the longitudinal direction is formed on the long fiber non-woven fabric F. The gripping member 11 is stopped when rotating by a predetermined number of rotations and rotates in the reverse direction after a predetermined time while gripping the long fiber non-woven fabric F. While the gripping member 11 is stopped, the long fiber non-woven fabric F is sent to the heating part 20 through the gripping member 11. Here, the time for stopping the gripping member 11 is appropriately determined in consideration of the volume of the first vertical crease (that is, the crease due to the first folding line) to be formed on the long fiber non-woven fabric F, the number of creases per unit length, and the like. Additionally, the rotation of the gripping member 11 may not be essentially stopped while the long fiber non-woven fabric F is sent.

In the gripping and rotating step, the twisting operation is repeated while switching the rotation direction of the gripping member 11. Additionally, the rotation direction of the gripping member 11 may not be always the same direction.

(First Heating Step)

The long fiber non-woven fabric F twisted by the gripping member 11 is sent to the heating part 20 and is sandwiched between the rollers 21 and 22 that generate heat while maintaining the state. Accordingly, the long fiber non-woven fabric F is heated in a twisted state and the temperature of the long fiber non-woven fabric F made of thermoplastic resin rises to exceed the crystallization temperature of polyethylene terephthalate.

The long fiber non-woven fabric F loses a temperature depending on the ambient environment temperature while being sent from the rollers 21 and 22 to the widening part 30 so that the temperature falls to the glass transition point or less of polyethylene terephthalate. Accordingly, the folding line (the first folding lines) in the longitudinal direction is fixed to the long fiber non-woven fabric F.

(First Widening Step)

The long fiber non-woven fabric F having the folding line fixed thereto is widened by the cross guiders 30A and 30B in the widening part 30. Accordingly, the long fiber non-woven fabric F is widened by releasing the crease (however, the first folding line remains fixed to the long fiber non-woven fabric F).

(Press-Inserting Step)

Next, in the horizontal creasing apparatus 2, the blade 73 is operated at equal time intervals while the long fiber non-woven fabric F sent from the widening part 30 to a gap between the drums 71 and 72 is continuously supplied in the longitudinal direction and the long fiber non-woven fabric F to be supplied to the drums 71 and 72 is pressed from the upstream side of the drums 71 and 72 into a gap between both drums. Accordingly, the press-inserted long fiber non-woven fabric F overlaps with the long fiber non-woven fabric F already sandwiched between the drums 71 and 72 and folded folds are formed on the long fiber non-woven fabric F sandwiched between the drums 71 and 72 (see FIG. 4). Accordingly, a folding line (a third folding line) in the width direction is formed on the long fiber non-woven fabric F. The blade 73 continuously forms folds by performing the next press-inserting operation when the long fiber non-woven fabric F is sent out by a predetermined length.

(Second Heating Step)

The long fiber non-woven fabric F is heated by the drums 71 and 72 that generate heat while maintaining the folds so that the temperature rises to exceed the crystallization temperature of polyethylene terephthalate.

The long fiber non-woven fabric F loses a temperature depending on the ambient environment temperature while being sent from the drums 71 and 72 so that the temperature falls to the glass transition point or less of polyethylene terephthalate. Accordingly, the folding line (the third folding line) in the width direction is fixed to the long fiber non-woven fabric F. The long fiber non-woven fabric F having the folding line fixed thereto in the width direction is drawn out from the horizontal creasing apparatus 2 in the longitudinal direction so that the crease is released. However, the folding line in the width direction is fixed to the long fiber non-woven fabric F as the horizontal crease.

(Second Widening Step)

The long fiber non-woven fabric F having the third folding line fixed thereto is widened while being wound on the center core 6 so that the fold is opened. However, the third folding line is fixed to the long fiber non-woven fabric F as the horizontal crease.

In the embodiment, the vertical crease W1 formed by the gripping and rotating step and the first heating step is fixed on the long fiber non-woven fabric F so as to draw continuous waves. Further, the horizontal crease W3 formed by the press-inserting step and the second heating step is fixed on the long fiber non-woven fabric F. Accordingly, since a restoring force applied in two directions of the width direction and the vertical direction is given to the long fiber non-woven fabric F, the bending habit of the crease can be maintained for a long time. As a result, the effects required for the long fiber non-woven fabric, for example, the effects such as heat retention last for a long time.

INDUSTRIAL APPLICABILITY

The present invention relates a creasing apparatus for forming a crease in a long fiber non-woven fabric and a creasing method of forming a crease in a long fiber non-woven fabric. According to the present invention, the bending habit of the crease formed on the long fiber non-woven fabric can be maintained for a long time and the effects required for the long fiber non-woven fabric such as heat retention can be fully exhibited.

REFERENCE SIGNS LIST

1 Vertical creasing apparatus (creasing apparatus)
10 Gripping and rotating part (first gripping and rotating part)
20 Heating part (first heating part)
30 Widening part (first widening part)
40 Gripping and rotating part (second gripping and rotating part)
50 Heating part (second heating part)
60 Widening part (second widening part)
71 Drum (first conveying body)
72 Drum (second conveying body)
Blade
80 Control unit
F Long fiber non-woven fabric
W1 First vertical crease
W2 Second vertical crease

The invention claimed is:

1. A creasing method comprising:

a gripping and rotating step of bunching and gripping a certain part of a continuously supplied long fiber non-woven fabric in a longitudinal direction and rotating the gripped part of the long fiber non-woven fabric within a plane intersecting a drawing direction of the long fiber non-woven fabric so that the long fiber non-woven fabric is twisted and a folding line in the longitudinal direction is formed on the long fiber non-woven fabric;

a first heating step of heating the twisted long fiber non-woven fabric to fix the folding line to the long fiber non-woven fabric after the first gripping and rotating step;

a first widening step of releasing the long fiber non-woven fabric having the folding line fixed thereto to widen the long fiber non-woven fabric in a width direction after the first heating step;

a press-inserting step of press-inserting the long fiber non-woven fabric to be supplied to a pair of conveying bodies from an upstream side of the pair of conveying bodies into a gap between both conveying bodies while conveying the long fiber non-woven fabric having the folding line, formed in the longitudinal direction by performing the gripping and rotating step, the first heating step, and the first widening step once or a plurality of times, using the pair of conveying bodies so that the long fiber non-woven fabric overlaps with the long fiber non-woven fabric already sandwiched between both conveying bodies and a folding line is formed on the long fiber non-woven fabric in the width direction; and a second heating step of fixing a folding line in the width direction to the long fiber non-woven fabric by heating the long fiber non-woven fabric overlapped by the press-inserting step.

2. The creasing method according to claim 1, wherein the gripping and rotating step, the first heating step, and the first widening step are performed once or a plurality of times.

3. The creasing method according to claim 1, wherein the gripping and rotating step repeats forward and reverse rotations of the long fiber non-woven fabric.

4. The creasing method according to claim 1, further comprising:

a second widening step of releasing and widening the long fiber non-woven fabric having the folding line fixed thereto by the second heating step.

5. The creasing method according to claim 4, wherein the press-inserting step, the second heating step, and the second widening step are performed once or a plurality of times.

6. The creasing method according to claim 1, wherein the long fiber non-woven fabric includes a plurality of first long fiber filaments which are arranged in parallel in a longitudinal direction and a plurality of second long fiber filaments which are arranged in parallel in a width direction of the first long fiber filament and are laminated and bonded to the first long fiber filaments.

7. The creasing method according to claim 1, wherein the long fiber non-woven fabric is made of a crystalline resin.

8. The creasing method according to claim 7, wherein the first heating step heats the long fiber non-woven fabric at a temperature which is higher than a crystallization temperature of the crystalline resin and is lower than a melting point thereof, and wherein the first widening step widens the long fiber non-woven fabric at a temperature equal to or lower than a glass transition point of the crystalline resin.

9. The creasing method according to claim 7, wherein the second heating step heats the long fiber non-woven fabric at a temperature which is higher than the crystallization temperature of the crystalline resin and is lower than the melting point thereof, and wherein the second widening step widens the long fiber non-woven fabric at a temperature equal to or lower than the glass transition point of the crystalline resin.

10. A creasing apparatus comprising:

a first gripping and rotating part which is configured to bunch and grip a certain part of a continuously supplied long fiber non-woven fabric and configured to rotate the gripped part of the long fiber non-woven fabric within a plane intersecting a drawing direction of the long fiber non-woven fabric so that the long fiber non-woven fabric is twisted and a first folding line in the longitudinal direction is formed on the long fiber non-woven fabric;

a first heating part which is disposed on a downstream side of the first gripping and rotating part in the drawing direction and configured to heat the long fiber non-woven fabric twisted by the first gripping and rotating part so that the first folding line is fixed to the long fiber non-woven fabric;

a first widening part which is disposed on a downstream side of the first heating part in the drawing direction and configured to release the long fiber non-woven fabric having the first folding line fixed thereto by the first heating part so that the long fiber non-woven fabric is widened in a width direction;

a second gripping and rotating part which is disposed on a downstream side of the first widening part in the drawing direction, which is configured to bunch and grip a certain part of the long fiber non-woven fabric, and configured to rotate the gripped part within a plane intersecting the drawing direction so that the long fiber non-woven fabric is twisted and a second folding line in the longitudinal direction is formed on the long fiber non-woven fabric;

a second heating part which is disposed on a downstream side of the second gripping and rotating part in the drawing direction and configured to heat the long fiber non-woven fabric twisted by the second gripping and rotating part so that the second folding line is fixed to the long fiber non-woven fabric; and a second widening part which is disposed on a downstream side of the second heating part in the drawing direction and configured to release the long fiber non-woven fabric having the second folding line fixed by the second heating part so that the long fiber non-woven fabric is widened in the width direction.

11. The creasing apparatus according to claim 10, wherein the first gripping and rotating part is capable of repeating forward and reverse rotations of the long fiber non-woven fabric.

12. The creasing apparatus according to claim 10, wherein the second gripping and rotating part is capable of repeating forward and reverse rotations of the long fiber non-woven fabric.

13. The creasing apparatus according to claim 10, wherein the number of rotations of the first gripping and rotating part is different from the number of rotations of the second gripping and rotating part.

14. The creasing apparatus according to claim 10, further comprising:

a first conveying body which is in contact with one surface of the long fiber non-woven fabric having the folding line formed by the creasing apparatus and is rotatable about a predetermined axis intersecting the width direction of the long fiber non-woven fabric;

a second conveying body which is in contact with the other surface of the long fiber non-woven fabric, is rotatable about the predetermined axis intersecting the width direction, and sandwiches the long fiber non-woven fabric between the first conveying body and the second conveying body; and a blade which is disposed on an upstream side of the first and second conveying bodies in the drawing direction and configured to press the long fiber non-woven fabric to be supplied to the first and second conveying bodies from an upstream side of the first and second conveying bodies into a gap between both conveying bodies so that the long fiber non-woven fabric overlaps with the long fiber non-woven fabric already sandwiched between both conveying bodies and a folding line in the width direction is formed on the long fiber non-woven fabric, wherein at least one of the first and second conveying bodies is a third heating part which heats the long fiber non-woven fabric sandwiched between the first and second conveying bodies so that the folding line in the width direction is fixed to the long fiber non-woven fabric.

* * * * *